United States Patent [19]

Freyer et al.

[11] Patent Number: 5,046,416

[45] Date of Patent: Sep. 10, 1991

[54] PRINTING UNIT FOR ROTARY PRINTING PRESSES

[75] Inventors: Norbet Freyer, Grossachsen; Norbert Thunker, Heidelberg, Fed. Rep. of Germany

[73] Assignee: Heidelberger Druckmaschinen Aktiengesellschaft, Heidelberg, Fed. Rep. of Germany

[21] Appl. No.: 296,434

[22] Filed: Jan. 12, 1989

[30] Foreign Application Priority Data

Jan. 12, 1988 [DE] Fed. Rep. of Germany ..... 3800570

[51] Int. Cl.[5] ..... B41F 7/26; B41F 31/20; B41F 35/04

[52] U.S. Cl. ..... 101/148; 101/349; 101/425

[58] Field of Search ..... 101/425, 423, 424, 350, 101/148, 351, 352, 144, 142, 349, 348

[56] References Cited

U.S. PATENT DOCUMENTS

| | | | |
|---|---|---|---|
| 3,410,206 | 11/1968 | Dorr . | |
| 3,749,014 | 7/1973 | Gates | 101/425 |
| 3,766,853 | 10/1973 | Gallagher | 101/425 |
| 4,270,450 | 6/1981 | Difflipp et al. | 101/425 |
| 4,311,095 | 1/1982 | Jeschke | 101/425 |
| 4,527,479 | 7/1985 | Dahlgren et al. | 101/350 X |
| 4,602,564 | 7/1986 | Sakamoto et al. . | |
| 4,660,470 | 4/1987 | Kramp et al. . | |

FOREIGN PATENT DOCUMENTS

| | | |
|---|---|---|
| 236052 | 5/1986 | German Democratic Rep. . |
| 869803 | 6/1961 | United Kingdom . |
| 2202490 | 3/1988 | United Kingdom . |

*Primary Examiner*—J. Reed Fisher

*Attorney, Agent, or Firm*—Herbert L. Lerner; Laurence A. Greenberg

[57] ABSTRACT

Printing unit for rotary printing presses having at least one printing unit and at least one ink-conduction cylinder comprising an engageable and disengageable ink-reducing unit assigned to one of the ink-conducting cylinders and having at least one roller, a doctor blade engageable with the one roller and an ink-collection trough, the one roller, while printing is stopped but while ink is being supplied, being in engagement with the ink-conducting cylinder for removing from the ink-conducting cylinder substantially a like portion of ink film which would otherwise be removed by paper being printed in the printing unit.

9 Claims, 4 Drawing Sheets

PRINTING UNIT FOR ROTARY PRINTING PRESSES

Figure 1:
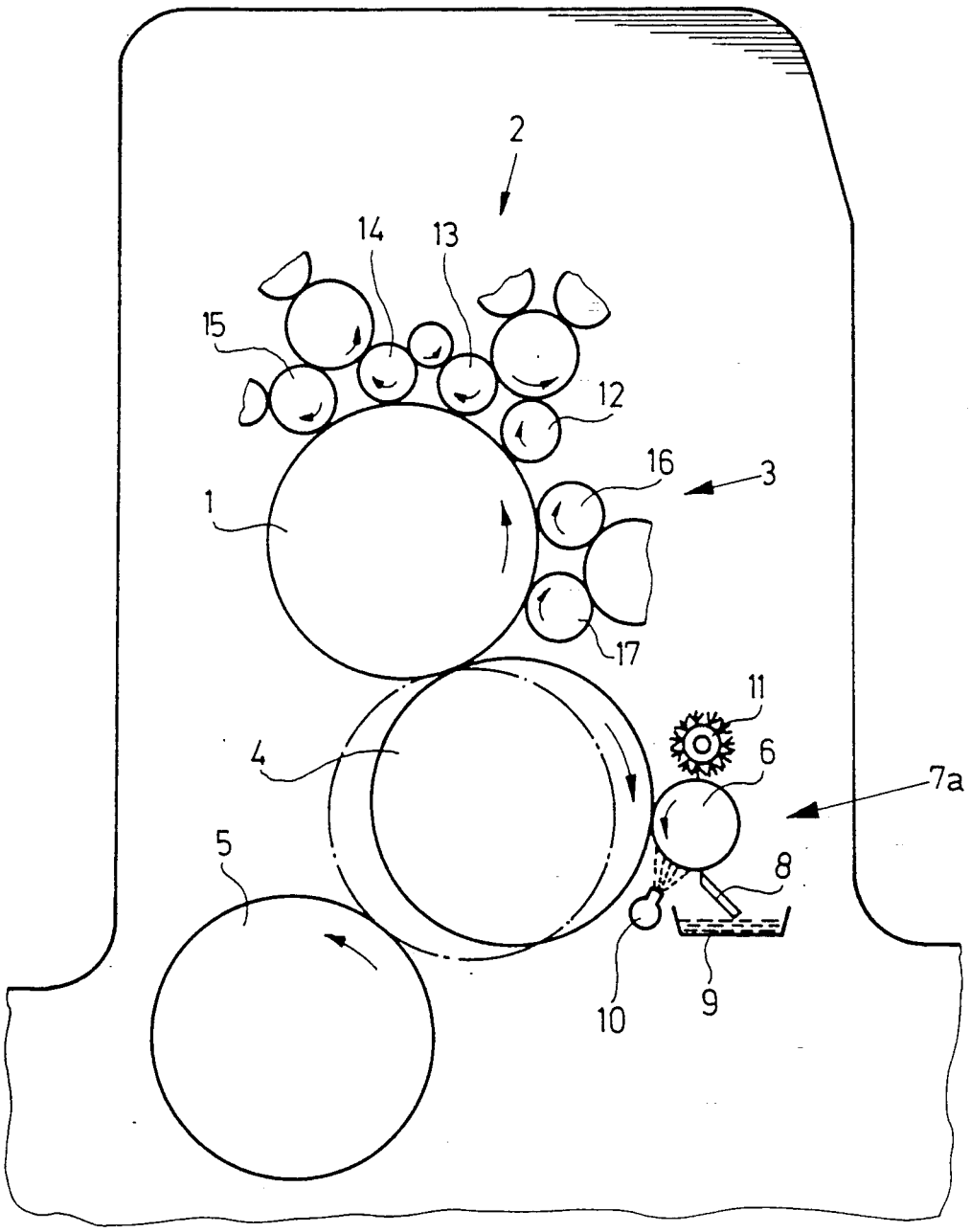

The invention relates to a printing unit for rotary printing presses having at least one inking unit, at least one ink-conducting cylinder, such as a plate cylinder or a blanket cylinder, and at least one paper-conducting cylinder, such as an impression cylinder, at least one of the ink-conducting cylinders being adjustably mounted.

In offset rotary printing presses, the setting of the printing unit to the ready state suitable for a production run calls for the fulfillment of two conditions: in the inking unit, the ink profile and in the printing unit as a whole, the ink/dampening solution emulsion, must have assumed the steady state suitable for a production run. Hereinafter, this steady state is referred to as equilibrium. In letterpress or dry-offset processes, which do not require the addition of dampening solution, the problems relating to ink/dampening solution equilibrium do not apply. The hereinafter-described problems that result in offset printing from setting the ink profile so that it is suitable for a production run can be applied without exception to letterpress and dry-offset printing.

In conventional printing units in offset rotary printing presses (Note: the brochure on Heidelberger Speedmaster presses 4/81), the setting of the printing unit to a ready state suitable for a production run at a new start of printing, proceeding from an empty inking unit, is achieved in several steps Initially, the inking unit is preset, with the form rollers being disengaged from the plate cylinder. German Patent (DE-PS) 33 38 143 describes a possible method which accomplishes this purpose wherein, first of all, a defined base ink-film thickness is produced on all of the inking-unit rollers In a second step, the ink profile is established. When the setting-up of the ink profile has been completed, the dampening unit and the printing plate are pre-dampened, with the blanket cylinder being disengaged from the plate cylinder and from the impression cylinder. Thereafter, the form rollers are brought into engagement with the plate cylinder. In order to avoid the buildup of ink on the printing plate, printing must be started immediately afterwards.

A disadvantage of the method described in the aforementioned German Patent (DE-PS) 33 38 143 is that it is always necessary to start from an empty inking unit and that, at the start of printing, the setting of the ink profile and of the ink/dampening solution emulsion to a state suitable for a production run has not yet been accomplished. The flow of ink/dampening solution within the printing unit necessary for a steady state production-run is obtained only when a large quantity of ink is removed from the blanket cylinder by means of paper. This leads to the production of so-called waste sheets. The problem of waste production due to the ink/dampening solution equilibrium being not yet stable during offset printing does not just occur at the start of printing or in the case of changes in profile. Interruptions in printing frequently occur during the production run. These interruptions may be foreseeable, such as the interruptions for washing the rubber blanket, which is necessary approximately every 3,000 prints. These interruptions may also be of an unforeseen nature e.g. as a result of stoppers. Each of these interruptions during printing disturbs the sensitive ink/dampening solution equilibrium in that ink and dampening solution are partially separated from one another inside the printing unit and in that there is a change in the printing characteristics of the emulsion. If printing is to be continued after the interruption, as a rule, the ink emulsion is no longer in a state suitable for a production run.

If the printer does not stop the entire press because of a fault that occurs, but merely interrupts the feeding of paper, the form rollers and dampening solution application rollers are disengaged from the plate cylinder, and the blanket cylinder is separated from the impression cylinder and from the plate cylinder, both of these operations taking place simultaneously and automatically. Because the inking unit continues to operate, ink continues to be transported towards the plate cylinder, which leads to an equalization or harmonization of the ink profile within the inking unit and which, moreover, changes the ink/dampening solution emulsion.

Before printing is started again, the ink profile and the ink/dampening solution emulsion must be restored to a state that is suitable for a production run.

If the printed sheet is insufficiently inked or if a change is made from one printing jobs to another, the ink-gap thicknesses at the duct roller are changed by readjustment of the metering elements. Before the printing unit is again in a production-run state appropriate to the new subject, it is necessary once again for a defined ink-film thickness and for the necessary ink/dampening solution emulsion to have been reestablished on all rollers within the inking unit.

In either of these cases, in conventional printing units, waste is printed until the necessary equilibrium has been re-established.

Proceeding from this state of the art, it is an object of the invention to provide a printing unit of the foregoing general type wherein the printing of waste is virtually eliminated when the printing unit is set to a state suitable for a production run.

With the foregoing and other objects in view, there is provided, in accordance with the invention, a printing unit for rotary printing presses having at least one printing unit and at least one ink-conduction cylinder comprising an engageable and disengageable ink-reducing unit assigned to one of the ink-conducting cylinders and having at least one roller, a doctor blade engageable with the one roller and an ink-collection trough, the one roller, while printing is stopped but while ink is being supplied, being in engagement with the ink-conducting cylinder for removing from the ink-conducting cylinder substantially a like portion of ink film which would otherwise be removed by paper being printed in the printing unit.

In another aspect of the invention, there is provided a printing unit for rotary printing presses having at least one inking unit and one dampening unit, and at least two ink-conducting cylinders, of which at least one is adjustably mounted, comprising an engageable and disengageable ink-reducing unit assigned to at least one of the ink-conduction cylinders and having at least one roller, a doctor blade engageable with the one roller and an ink-collection trough, the one roller, while printing is stopped but while ink and dampening solution are being supplied, being in engagement with one of the ink-conducting cylinders for removing from the ink-conducting cylinder substantially a like portion of ink and dampening solution film which would otherwise be removed by paper being printed in the printing unit.

In a further aspect of the invention, there is provided a printing unit for rotary printing presses having at least one inking unit, an ink-conducting cylinder, and an adjustably mounted paper-conducting cylinder, comprising an engageable and disengageable ink-reducing unit assigned to the ink-conducting cylinder and having at least one roller, a doctor blade engageable with the one roller and an ink-collection trough, the one roller, while printing is stopped, but while ink is being supplied, being in engagement with the ink-conducting cylinder for removing from the ink-conducting cylinder substantially a like portion of ink film which would otherwise be removed by paper being printed in the printing unit.

By the application of the measures according to the invention, it is possible to reduce the production of waste from at present, 150 to 200 prints at the start of printing or in the case of major changes in profile to only 2 to 3 sheets of waste for each interruption in printing.

This results in a reduction in the costs for each printing job, because the paper cost is saved.

An advantageous further development of the invention is that the roller that is in engagement with the blanket cylinder or with the plate cylinder is driven by friction by the blanket cylinder or by the plate cylinder This makes it possible to operate without a separate drive for the roller.

Advantageous further developments of the printing unit according to the invention result from the choice of the surface materials for the rollers of the inking-reducing unit. Several advantages are afforded by a rigid surface of the rollers. This has the positive quality of having high resistance to wear with respect to the doctor blade. This permits the use of a simple spring-steel blade as the doctor blade, which results in an efficient wiping of the surface of the roller. Furthermore, the heat generated during wiping by the doctor blade, which otherwise flows into the printing unit and disturbs the ink/dampening solution equilibrium is negligibly small. Chromium oxide or aluminum oxide is preferably used as the material for the surface of the roller If yieldable or flexible material, such as rubber, is used for a roller that is brought into engagement with the plate cylinder, the printing plate is thus protected against wear.

In accordance with an added feature of the invention the one roller has a surface engageable with the one ink-conducting cylinder, the surface being yieldable, and the ink-conducting cylinder being formed of a rigid material.

In accordance with an additional feature of the invention the one roller has a surface engageable with the one ink-conducting cylinder, the surface being rigid and the ink-conducting cylinder being formed of a yieldable material.

In accordance with again another feature of the invention the inking-reducing unit has a solvent-supplying device assigned thereto for applying solvent to the roller of the inking-reducing unit while the roller is in engagement with the ink-conducting cylinder.

In accordance with again a further feature of the invention the at least one roller of the ink-reducing unit is constructed so as to have the same diameter as that of the ink-conducting cylinder to which it is assigned.

In accordance with again an added feature of the invention with an impression cylinder and wherein the impression cylinder serves as a roller of the inking-reducing unit, the doctor blade of the ink-reducing unit being assigned to the impression cylinder and being adjustably mounted.

In accordance with again an additional feature of the invention the inking-reducing unit serves also as a cylinder-washing device.

In accordance with yet another feature of the invention the inking-reducing unit is assigned an actuating device, a print-quality-measuring device controllable by the actuating device for bringing the inking-reducing unit automatically into and out of its working position if at least one machine parameter relevant for the detection of the print quality has attained a given setpoint value and if deviations therefrom are detected, respectively.

In accordance with yet a further feature of the invention the one roller of the inking-reducing unit is in engagement with the ink-conducting cylinder and is driven by friction by the ink-reducing unit.

In accordance with a concomitant feature of the invention the one roller has a surface engageable with the one ink-conducting cylinder, the surface being rigid, and the ink-conducting cylinder being formed of a yieldable material.

If one of the rollers of the inking-reducing unit is separately drivable, the unit can be operated in such a manner that it is self-cleaning if cleaning solution is applied to the rotatable roller. Furthermore. the inking-reducing unit can also be used as a cylinder-washing apparatus.

Other features which are considered as characteristic for the invention are set forth in the appended claims.

Although the invention is illustrated and described herein as embodied in a printing unit for rotary printing presses, it is nevertheless not intended to be limited to the details shown, since various modifications and structural changes may be made therein without departing from the spirit of the invention and within the scope and range of equivalents of the claims.

Figure 2:
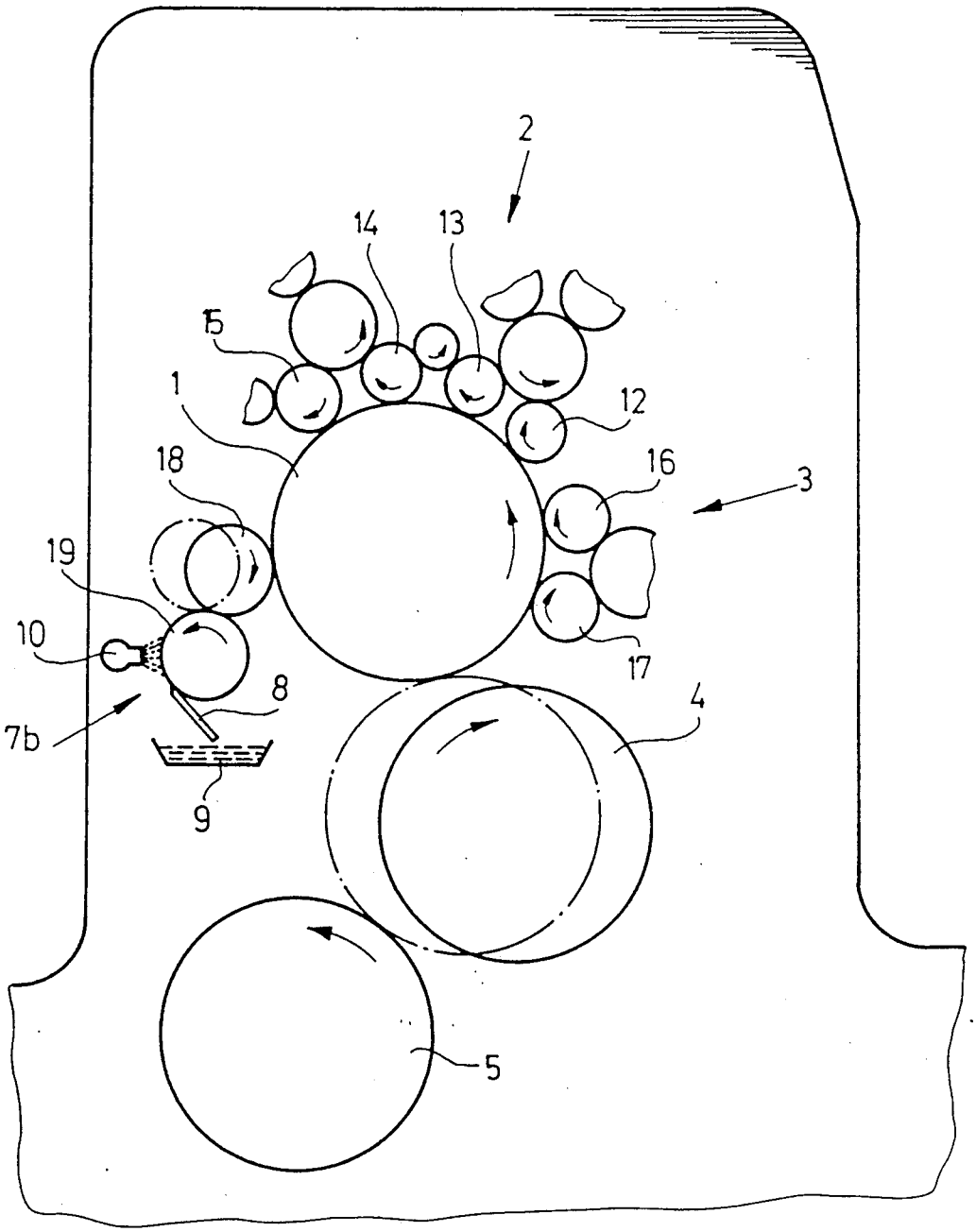
Figure 3:
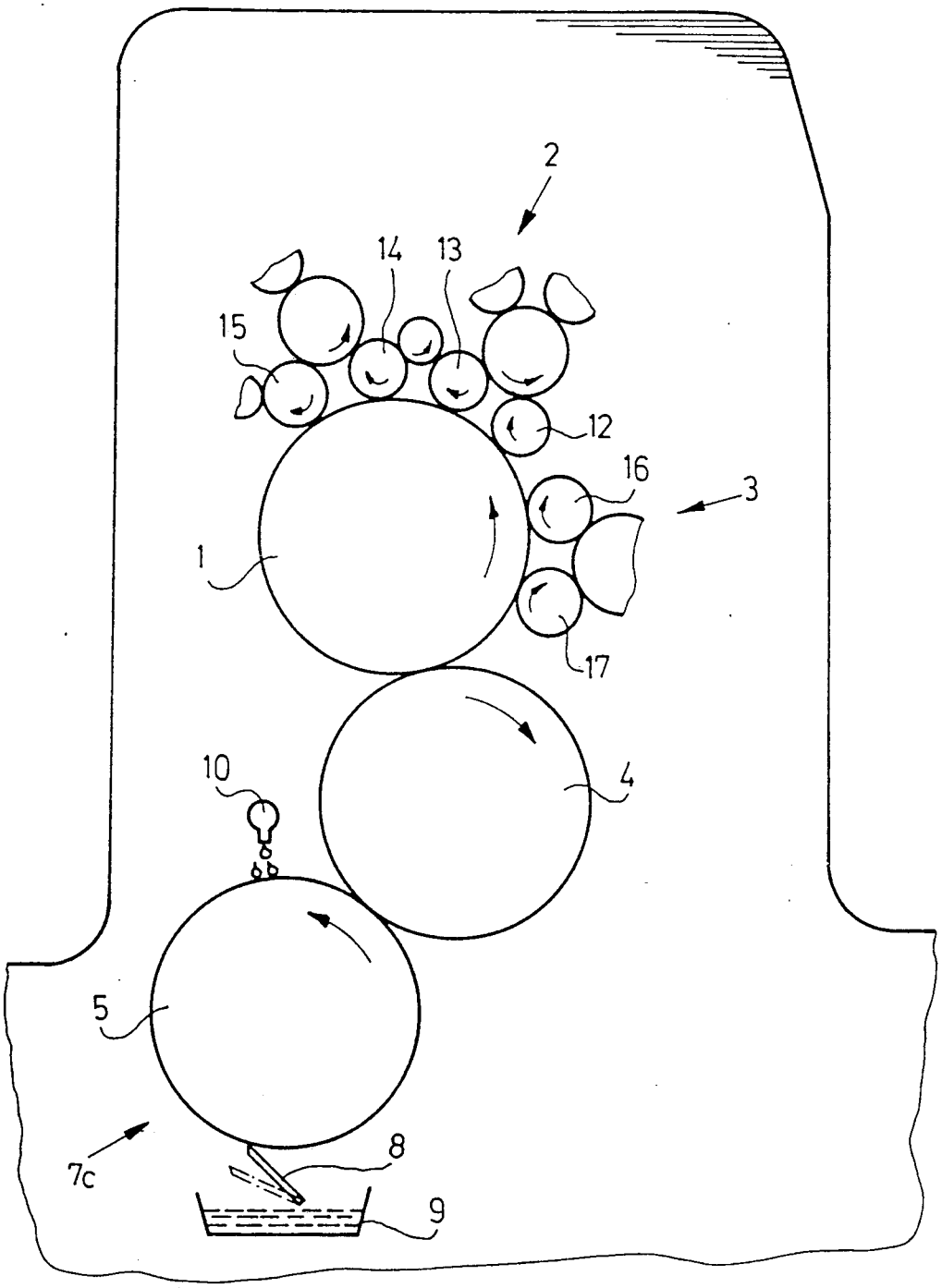
Figure 4:
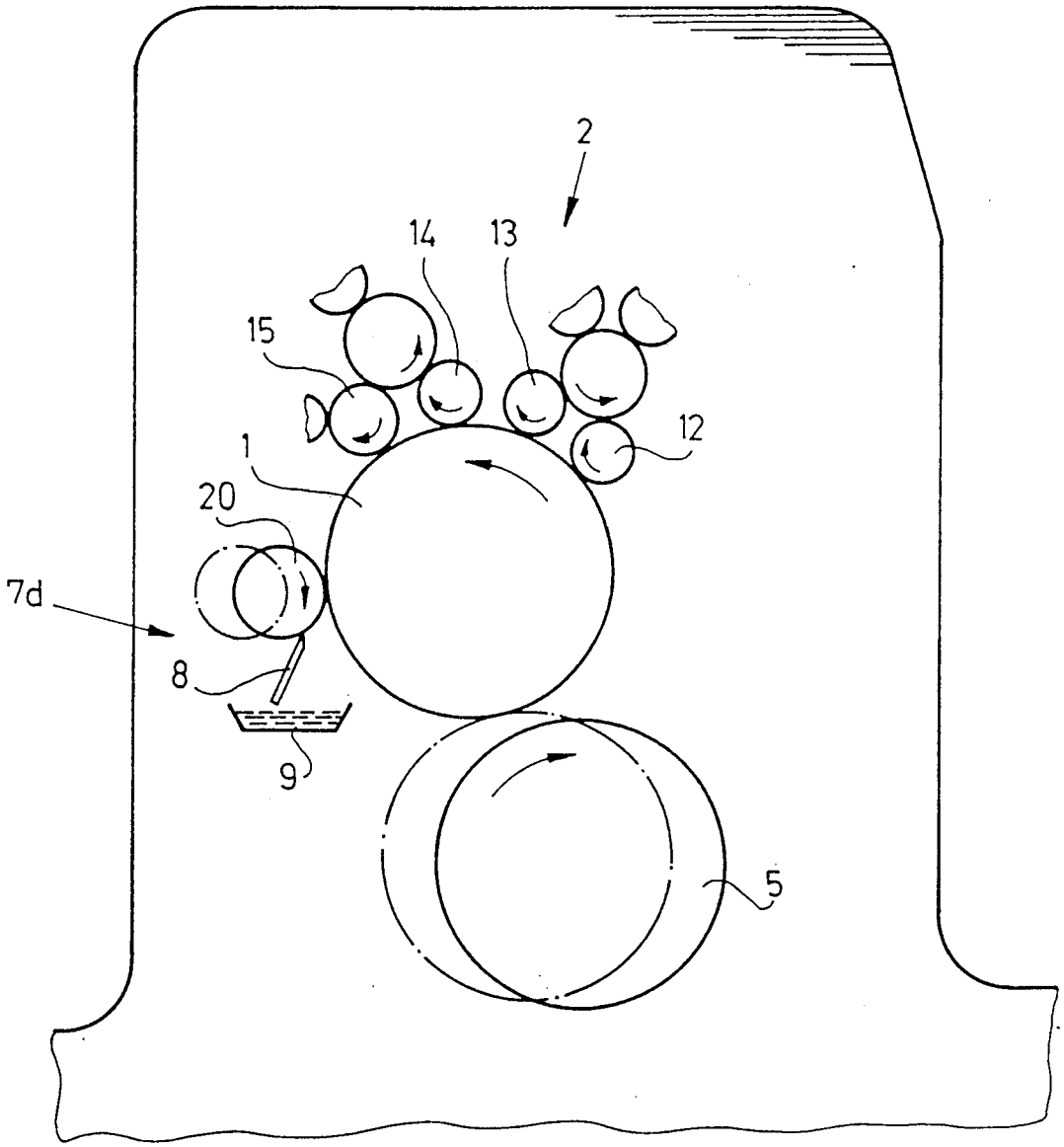

The construction and method of operation of the invention, however, together with additional objects and advantages thereof will be best understood from the following description of specific embodiments when read in connection with the accompanying drawings, in which:

FIG. 1 is a diagrammatic view of a printing unit with one embodiment of the device according to the invention; and FIGS. 2, 3 and 4 are similar views with other embodiments of the device.

Referring now to the drawing and, first, particularly to FIG. 1, there is shown therein the construction of the printing unit according to the invention. The supply of ink and dampening solution to the plate cylinder 1 is effected by an inking unit 2 and a dampening unit 3. In engagement with the plate cylinder 1 is a rubber-blanket cylinder 4, which is in contact either with an impression cylinder 5 or with a roller 6. The roller 6, which is driven by friction by the blanket cylinder 4, is a component of an ink-reducing unit 7*a*, which also includes a doctor blade 8 executing a traversing motion, and a removable ink-collection trough 9.

The system also includes a solvent-supplying device 10, which applies solvent to a surface region of the roller 6 lying, as viewed in FIG. 1, in the direction of rotation of the roller 6, between the rubber-blanket cylinder 4 and the doctor blade 8. This facilitates the wiping of the ink from the roller 6. In order to remove the final remainder of ink from the roller, it is possible for a brush 11 to be additionally provided. This brush rotates either in a direction opposite to that of the roller 6 or in the same direction at a different speed of rotation. In order to prevent the formation of doctor-blade tracks or grooves, the doctor blade executes a traversing motion. At a new printing start, an inking profile is initially preset in the inking unit, the form rollers 12 to 15 being disengaged from the plate cylinder 1. Then, the dampening unit 3 and the plate cylinder 1 are predampened. For this purpose, the dampening solution application rollers 16 and 17 are brought into engagement with the plate cylinder 1. Thereafter, the form rollers 12 to 15 are likewise brought into engagement with the plate cylinder 1 in order to ink the printing plate. Simultaneously, the supplying of solvent is started and the blanket cylinder 4 is brought into engagement with the plate cylinder 1 and with the roller 6. The portion of ink and dampening solution that would otherwise be transferred to the paper is wiped off the roller 6 until an ink profile suitable for a production run as well as a stable ink/dampening solution equilibrium has been established. Then, the blanket cylinder 4 is brought into engagement with the impression cylinder 5, and sheet feeding is started. The feeding of solvent to the roller 6 is stopped. If the stability of the ink profile is no longer assured, during printing, due to a change in the setting of the ink-gap thickness, or if a stopper has occurred which disrupts the ink/dampening solution equilibrium, the paper feed is stopped and the blanket cylinder 4 is disengaged from the impression cylinder 5 and is brought into engagement with the roller 6. The ink-reducing unit *7a* operates until the state suitable for a production run has been established both in the ink profile as well as in the ink/dampening solution equilibrium. Then, the blanket cylinder 4 is disengaged from the roller 6 and is brought into engagement with the impression cylinder 5. Simultaneously, the paper feed is again started.

When the press has been started after a lengthy interruption in printing e.g. over night, the ready state for a production run is attained after approximately 200 revolutions of the press. A relevant machine parameter for evaluating the setting of the state that is suitable for a production run is the number of revolutions after the press start-up, for example. The required number of press revolutions after the press is stationary is highly dependent upon the subject, the zone-wide ink-gap thicknesses at the duct roller and the time during which the press was shut down. From these parameters it is possible to determine a defined, required number of press revolutions for setting the ready state for a production run. When a counter has counted this defined number of press revolutions, it sends a signal to an actuating device of the ink-reducing unit *7a*, and the blanket cylinder 4 is disengaged from the roller 6 and brought into engagement with the impression cylinder 5. Simultaneously, the sheet feeding is started and the supplying of solvent is interrupted. The setting of the ready state for a production run can also be checked by means of a measuring system, which then furnishes the signal to deactivate the ink-reducing unit. In order to prevent an undesired, locally offset retransfer of ink from the roller 6 to the blanket cylinder 4 and thus a relocated duplication of the printed image by ink which has not been fully wiped off, the roller 6 may be constructed so as to have the same circumference as that of the blanket cylinder 4. The ink that has been wiped off, and which collects in the removable ink-collection trough 9, can be returned to the ink duct (which is not shown in the drawing in the interest of clarity), either manually or by means of a pumping apparatus, if necessary or desirable, after the ink has been cleaned.

FIG. 2 shows another embodiment of the printing unit according to the invention. If the printing unit is not in a ready state suitable for a production run, either after a new printing start or after a stopper, the roller 18 of the ink-reducing unit *7b* is brought into engagement with the plate cylinder 1 and the feeding of solvent is started, with the blanket cylinder 4 being disengaged from the plate cylinder 1 and from the impression cylinder 5. The roller 18 has a yielding or flexible surface; conversely, the roller 19 is provided with a nonyielding or rigid surface. The ink is transferred from the plate cylinder 1 by splitting to the roller 18 and from there, also by splitting, to the roller 19, from which it is wiped off by the doctor blade 8. It is possible in this embodiment also to have the doctor blade 8 execute a traversing motion in order to prevent the formation of doctor-blade tracks or grooves. The removal of ink from the roller 19 may again be aided by a solvent-supplying device 10, which, in this case, is in the form of a spraying device Because the ink-reducing unit is brought into engagement with the plate cylinder in this embodiment, a complete wipe-off of the ink is not of such major importance, because the supply of ink to the plate comes from all parts of the inking unit anyway.

When the ready state for a production run has been established, the roller 18 is disengaged from the plate cylinder the blanket cylinder 4 is brought into engagement with the plate cylinder 1 and with the impression cylinder 5, and sheet feeding is started. The ink-reducing unit *7b* is automatically self-cleaning in that the rotational motion of the rollers 18 and 19 and the supplying of solvent are maintained for some time. When cleaning has been completed, the supply of solvent is stopped and the rotation of the rollers is interrupted.

FIG. 3 represents a further embodiment of the printing unit according to the invention, wherein the impression cylinder 5 is operated as a roller of the ink-reducing unit *7c*, from which the ink is wiped off. A drop-dispenser bar serves in this case as the solvent-supplying device 10. In order to set the ready state for a production run, the doctor blade 8 is brought into engagement with the impression cylinder 5 and the feeding of solvent is started. When the ink profile within the inking unit 2 has become stable and the ink/dampening solution equilibrium has been established, the feeding of solvent is interrupted, the doctor blade 8 is disengaged from the impression cylinder 5 and sheet feeding is started. With regard to the mounting of the doctor blade, care must be taken that a collision with the grippers in the cylinder channel is prevented. for this purpose, either the movement of the doctor blade or the movement of the grippers can be modified The doctor blade 8 can be prevented from dropping into the cylinder duct by appropriate doctor-blade guides.

FIG. 4 shows a printing unit for high-speed presses with a fourth embodiment of the device according to the invention. In this case, the ink-reducing unit *7d* is formed of a roller 20, the doctor blade 8 and the ink-collection trough 9. The operating principle is analogous to that described with regard to the foregoing embodiment of the device.

The foregoing is a description corresponding in substance to German Application P 38 00 570.0, dated Jan. 12, 1988, the International priority of which is being claimed for the instant application, and which is hereby made part of this application.

We claim:

1. A rotary printing press comprising at least one printing unit with at least one ink-conducting cylinder for printing on a material and an inking unit for supplying ink to the one ink-conducting cylinder, the printing press having means for stopping the printing unit from printing on a printing material while the inking unit continues to supply ink to the one ink-conducting cylinder, an ink-reducing unit having means engageable with and disengageable from the one ink-conducting cylinder, said ink-reducing unit having at least one roller, a doctor blade engageable with said one roller, and an ink-collection trough disposed below said doctor blade; means maintaining said one roller, while the printing is stopped and while ink is being supplied to the one ink-conducting cylinder, in engagement with the one ink-conducting cylinder for removing from the one ink-conducting cylinder substantially a like portion of ink film which would otherwise be removed by the printing material being printed in the printing unit so as to provide an ink profile suitable for a production run as well as to establish a stable ink solution equilibrium.

2. A rotary printing press according to claim 1, wherein said one roller has a surface engageable with the one ink-conducting cylinder, said surface being yieldable, and the one ink-conducting cylinder being formed of a rigid material.

3. A rotary printing press according to claim 1, wherein said one roller has a surface engageable with the one ink-conducting cylinder, said surface being rigid and the one ink-conducting cylinder being formed of a yieldable material.

4. A rotary printing press according to claim 1, including a solvent-supplying device located adjacent said ink-reducing unit for applying solvent to said roller of said ink-reducing unit while said roller is in engagement with the one ink-conducting cylinder.

5. A rotary printing press according to claim 1, wherein said at least one roller of said ink-reducing unit has a diameter substantially equal to that of the one ink-conducting cylinder.

6. A rotary printing press according to claim 1, wherein said at least one roller is an impression cylinder.

7. A rotary printing press according to claim 1, wherein said one roller of said ink-reducing unit is separately drivable.

8. A rotary printing press comprising at least one inking unit, at least one dampening unit, and at least one printing unit with at least two ink-conducting cylinders for printing on a material, inking and the one dampening unit being in engagement with at least one of the ink-conducting cylinders for respectively supplying ink and dampening solution thereto, the printing press having means for stopping the printing unit from printing on a printing material while the inking and the dampening units continue to supply ink and dampening solution, respectively, to the one ink-conducting cylinder, an ink-reducing unit having means engageable with and disengageable from at least one of the ink-conducting cylinders, said ink-reducing unit having at least one roller, a doctor blade engageable with said one roller and an ink-collection trough; means maintaining said one roller, while printing is stopped but while ink and dampening solution are being supplied, in engagement with at least one of the ink-conducting cylinders from removing from the last-mentioned ink-conducting cylinder substantially a like portion of ink and dampening solution film which would otherwise be removed by material being printed in the printing unit so as to provide an ink profile suitable for a production run as well as to establish a stable ink solution equilibrium.

9. A rotary printing press comprising a printing unit having at least one inking unit, an ink-conducting cylinder for printing on a material adjustably mounted cylinder for guiding material to be printed, the inking unit being in engagement with the ink-conducting cylinder, the printing press having means for stopping the printing unit form printing on the material to be printed while the inking unit continues to supply ink to the ink-conducting cylinder, an ink-reducing unit having means engageable with and disengageable from the ink-conducting cylinder, said ink-reducing unit having at least one roller, a doctor blade engageable with said one roller, and an ink-collection trough; means maintaining said one roller, while the printing is stopped, but while ink is being supplied to the ink-conducting cylinder, in engagement with the ink-conducting cylinder for removing from the ink-conducting cylinder substantially a like portion of ink film which would otherwise be removed by the material being printed in the printing unit so as to provide an ink profile suitable for a production run as well as to establish a stable ink solution equilibrium.

* * * * *